US011046398B2

(12) United States Patent
Enyart

(10) Patent No.: US 11,046,398 B2
(45) Date of Patent: Jun. 29, 2021

(54) ROTATIONAL MOLDED NARROW BEAM CATAMARAN WITH MODULAR ATTACHMENTS

(71) Applicant: William Eugene Enyart, Lafayette, CO (US)

(72) Inventor: William Eugene Enyart, Lafayette, CO (US)

( * ) Notice: Subject to any disclaimer, the term of this patent is extended or adjusted under 35 U.S.C. 154(b) by 0 days.

(21) Appl. No.: 17/070,887

(22) Filed: Oct. 14, 2020

(65) Prior Publication Data

US 2021/0107605 A1 Apr. 15, 2021

Related U.S. Application Data

(60) Provisional application No. 62/914,854, filed on Oct. 14, 2019.

(51) Int. Cl.

| | |
|---|---|
| ***B63B 35/38*** | (2006.01) |
| ***B63B 3/48*** | (2006.01) |
| ***B63H 16/04*** | (2006.01) |
| ***B63H 25/00*** | (2006.01) |
| ***B63H 21/12*** | (2006.01) |
| ***B63B 1/12*** | (2006.01) |

(52) U.S. Cl.

CPC ..... *B63B 35/38* (2013.01); *B63B 1/125* (2013.01); *B63B 3/48* (2013.01); *B63H 16/04* (2013.01); *B63H 21/12* (2013.01); *B63H 25/00* (2013.01)

(58) Field of Classification Search

CPC ..... B63B 35/00; B63B 35/38; B63B 1/00; B63B 1/125; B63B 3/00; B63B 3/48; B63B 16/00; B63B 16/04; B63B 21/00; B63B 21/12; B63B 25/00; B63B 17/00; B63H 16/00; B63H 16/04; B63H 21/00; B63H 21/12; B63H 25/00; B63H 25/04; B63H 25/06; B63H 9/00

USPC ..... 114/61.1, 343, 354, 364, 347, 39.12, 114/39.14, 39.15

See application file for complete search history.

(56) References Cited

U.S. PATENT DOCUMENTS

| | | | | |
|---|---|---|---|---|
| 3,179,960 | A * | 4/1965 | Nimmo | B63B 7/04 114/354 |
| 5,413,066 | A * | 5/1995 | Spencer, Jr. | B63B 7/082 114/354 |
| 6,508,194 | B2 * | 1/2003 | Myers | B63B 1/121 114/354 |
| 6,516,736 | B1 | 2/2003 | Van Lancker | |
| 6,582,264 | B2 * | 6/2003 | Brown | B63B 7/082 114/354 |
| 6,739,281 | B1 * | 5/2004 | Grimes | B63B 29/06 114/364 |
| 6,871,607 | B2 * | 3/2005 | Trepanier | B63B 35/34 114/61.1 |
| 7,370,593 | B1 * | 5/2008 | Horais | B63H 25/10 114/61.1 |
| 7,461,612 | B1 * | 12/2008 | Houck | B63B 1/121 114/347 |
| 8,516,971 | B1 * | 8/2013 | Natoce | B63B 17/00 114/364 |

(Continued)

*Primary Examiner* — Lars A Olson
(74) *Attorney, Agent, or Firm* — Will Hunziker

(57) ABSTRACT

A narrow beam rotomolded foam filled catamaran that incorporates regular points of attachment through the deck and a tubular frame that is highly customizable with modular accessories making it ideal for maneuverability, stability, durability, transportation, storage, and customization.

15 Claims, 6 Drawing Sheets

(56) References Cited

U.S. PATENT DOCUMENTS

| | | | |
|---|---|---|---|
| 9,856,001 | B2 | 1/2018 | Beer |
| 10,144,487 | B1 | 12/2018 | Craig |
| 2001/0032574 | A1 | 10/2001 | Newton |
| 2006/0096518 | A1 | 5/2006 | Hulbert |
| 2007/0283869 | A1 | 12/2007 | Quinn |

* cited by examiner

ROTATIONAL MOLDED NARROW BEAM CATAMARAN WITH MODULAR ATTACHMENTS

CROSS REFERENCE TO RELATED APPLICATIONS

This application claims the benefit of U.S. Provisional Patent Application No. 62/914,854, filed on Oct. 14, 2019, also titled "Rotational Molded Narrow Beam Catamaran with Modular Attachments" which is incorporated by reference herein in its entirety for all purposes.

BACKGROUND OF THE INVENTION

1. Field of the Invention

The present invention is in the technical field of boat designs, more particularly, the present invention pertains to the field of hull designs and outfitting for catamaran watercraft.

The present invention is most similar to the pattino; which is small catamaran used by Italian life guards and included a shallow draft, narrow beam, and oars and is designed to be used by one man standing up; except, the present invention is a lighter more durable and buoyant shallow draft narrow beam catamaran rotomolded with extensive regular points of attachment to make the boat highly modular and customizable for a variety of common uses. In this respect it is unlike any currently available watercraft and is ideal for use on rivers. The boat is designed with an optimum amount of rocker from back to front and side to side for maximum stability and agility, while the aggressive entry and rotomolded durability allow it to handle large white water, waves, and rocks easily.

The present invention has the benefits of the stability and speed of a catamaran, while also having modular attachments that can be easily removed, stored, and swapped with other attachments. In its smaller embodiments, the boat can be easily transported on top of a vehicle, while in its larger embodiments it will tow easily behind a vehicle due to its light weight. The flat height of the catamaran allows the boat to be stored easily in a garage against a wall without prohibiting the parking of cars.

The regular points of attachment and modular nature of the accessories also allows the boat to be outfitted for a variety of uses according to the user's desires. One embodiment includes a motor, while the tubular frame allows for the attachment of standard oars and rafting accessories.

SUMMARY

The scope of the present invention is defined solely by the appended claims and detailed description of a preferred embodiment and is not affected to any degree by the statements within this summary. In addressing many of the problems experienced in the related art, such as those relating to fishing boats, rafts, skiffs, and lightweight trollers, the present disclosure generally involves a small, narrow beam rotomolded foam filled catamaran that incorporates regular points of attachment through the deck and a tubular frame that is highly customizable with modular accessories making it ideal for maneuverability, stability, durability, transportation, storage, and customization.

BRIEF DESCRIPTION OF THE DRAWINGS

Various embodiments are described herein with reference to the following Drawings. Certain aspects of the Drawings are depicted in a simplified way for reason of clarity. Not all alternatives and options are shown in the Drawings and, therefore, the Claims are not limited in scope to the content of the Drawings.

1. FIGURES

Figure 1:
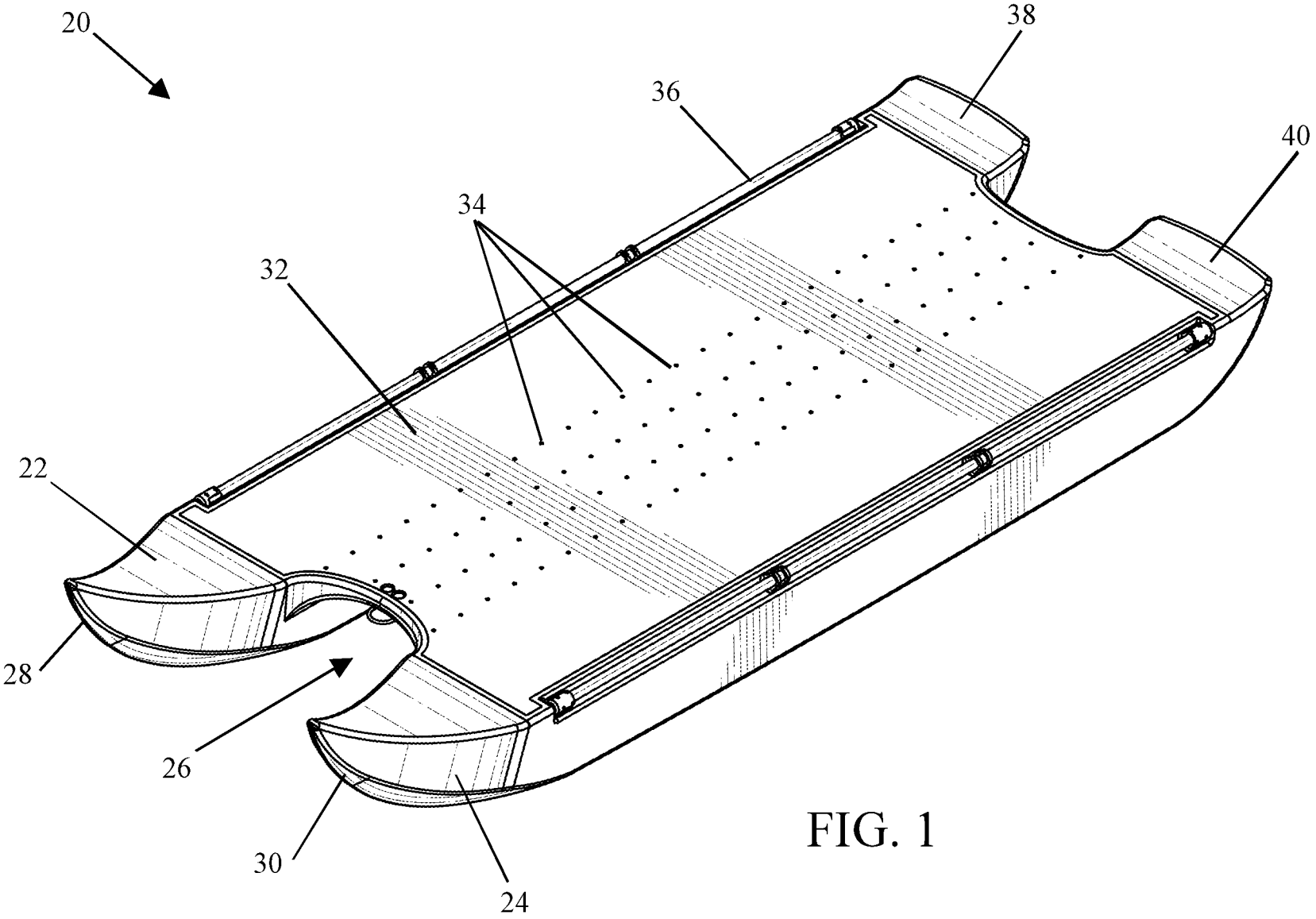

FIG. 1 illustrates a perspective view of a rotomolded narrow beam catamaran, in accordance with an embodiment of the present disclosure.

Figure 2:
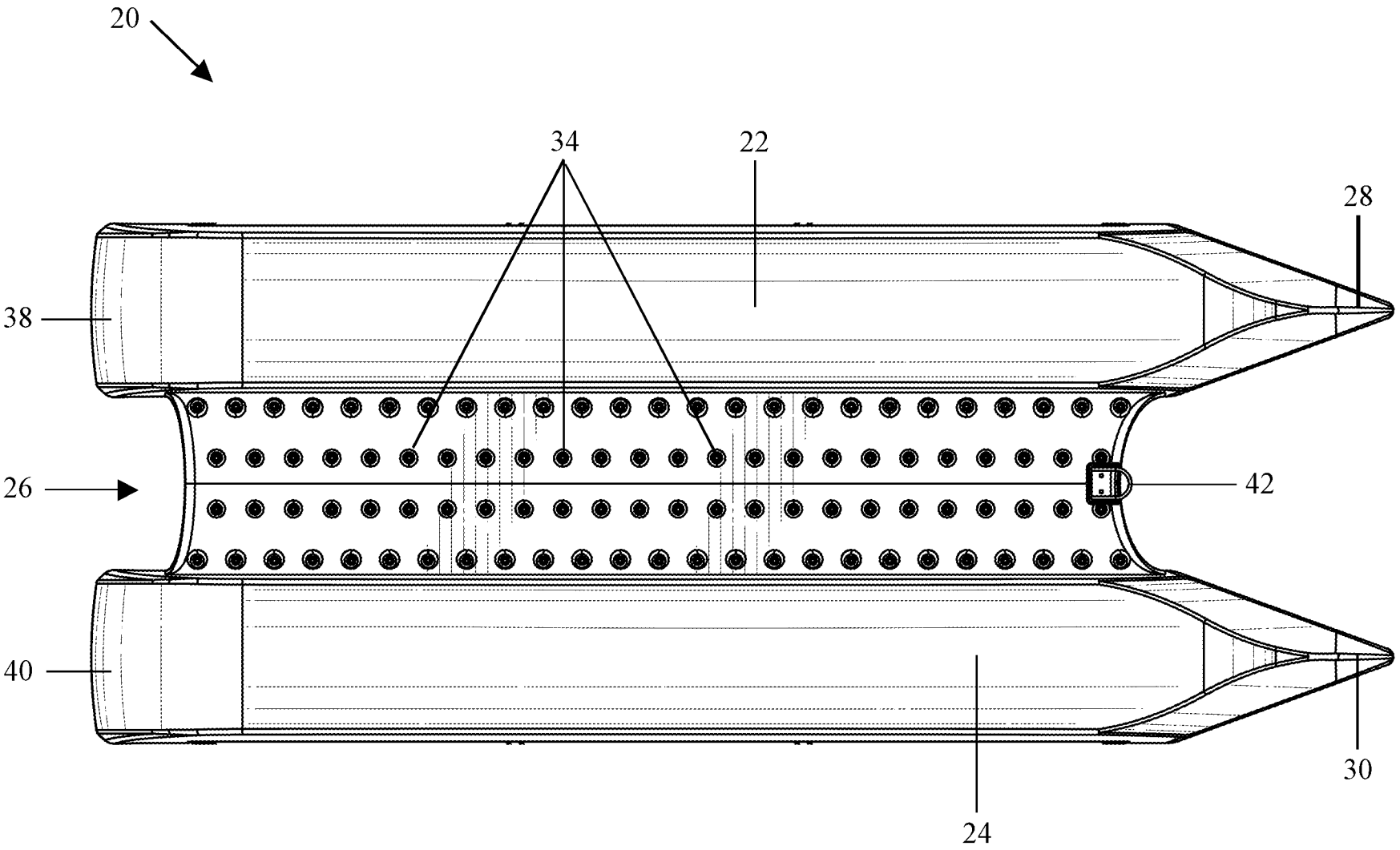

FIG. 2 illustrates a bottom view of a rotomolded narrow beam catamaran, in accordance with an embodiment of the present disclosure.

Figure 3:
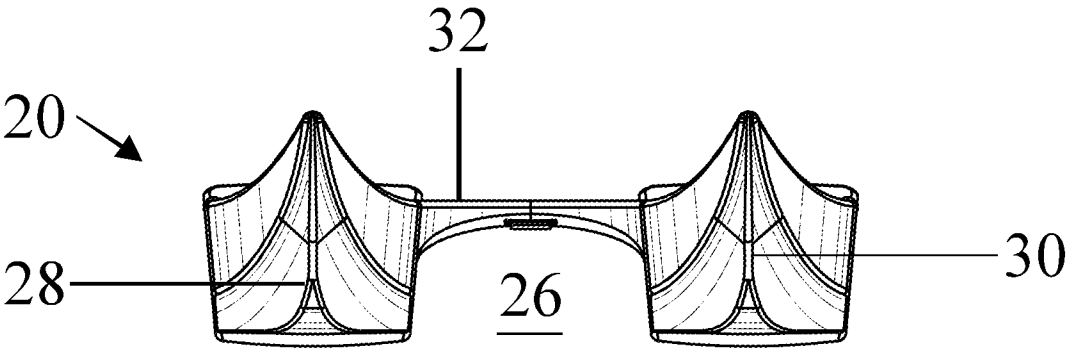

FIG. 3 illustrates a front view of a rotomolded narrow beam catamaran, in accordance with an embodiment of the present disclosure.

Figure 4:
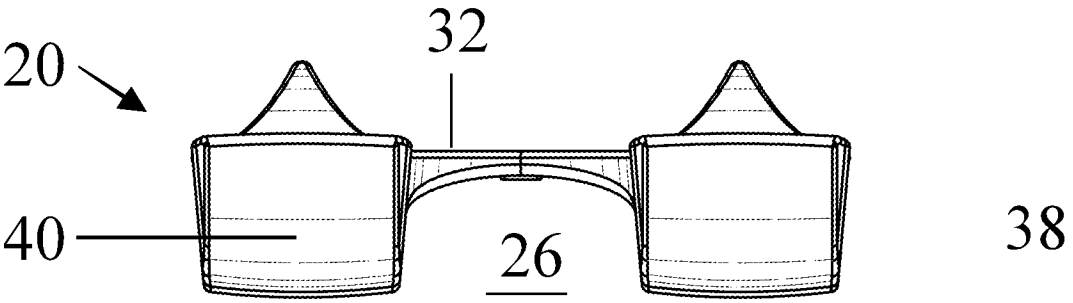

FIG. 4 illustrates a rear view of a rotomolded narrow beam catamaran, in accordance with an embodiment of the present disclosure.

Figure 5:
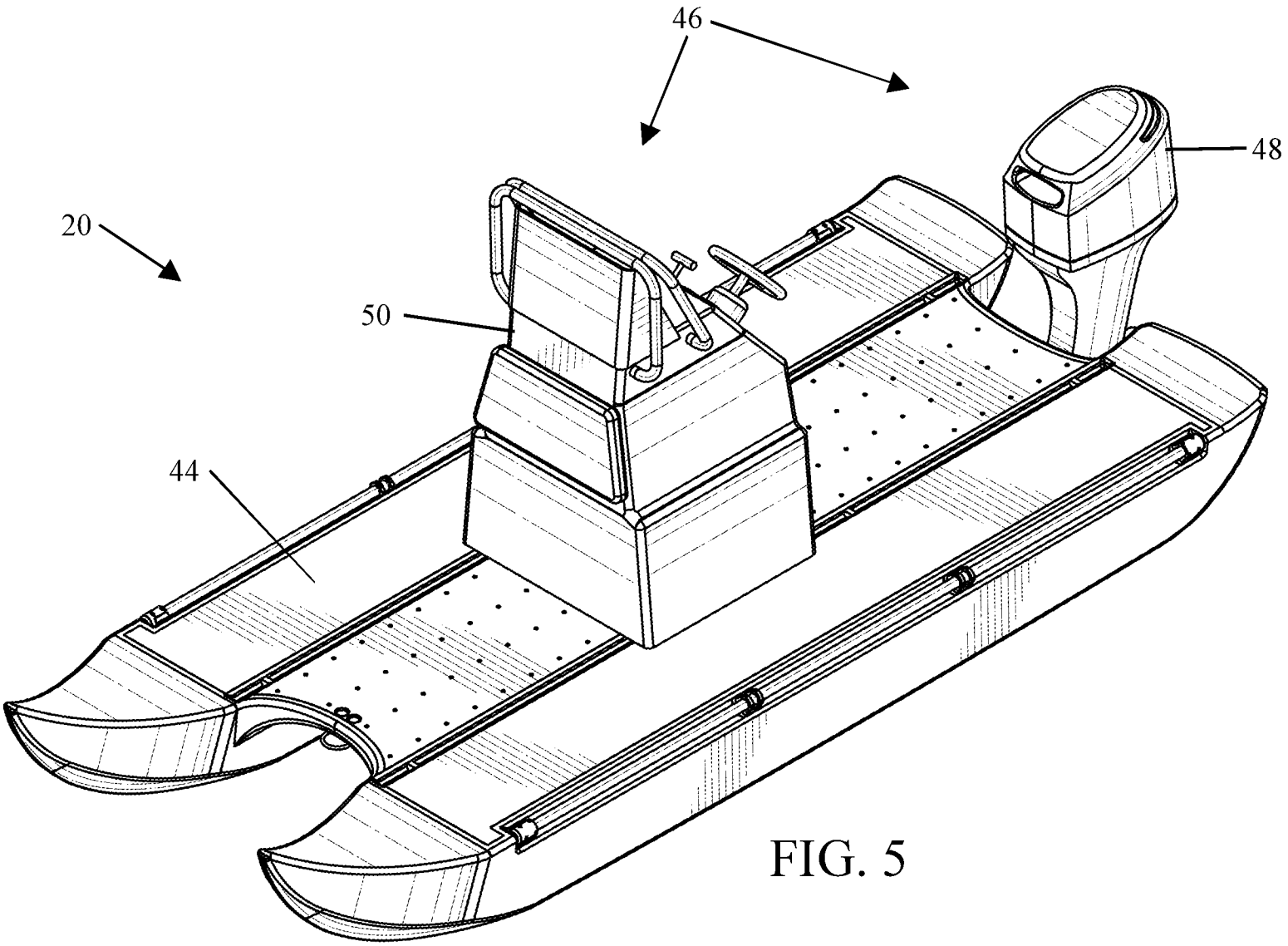

FIG. 5 illustrates a view of a rotomolded narrow beam catamaran with steering column and motor, in accordance with an embodiment of the present disclosure.

Figure 6:
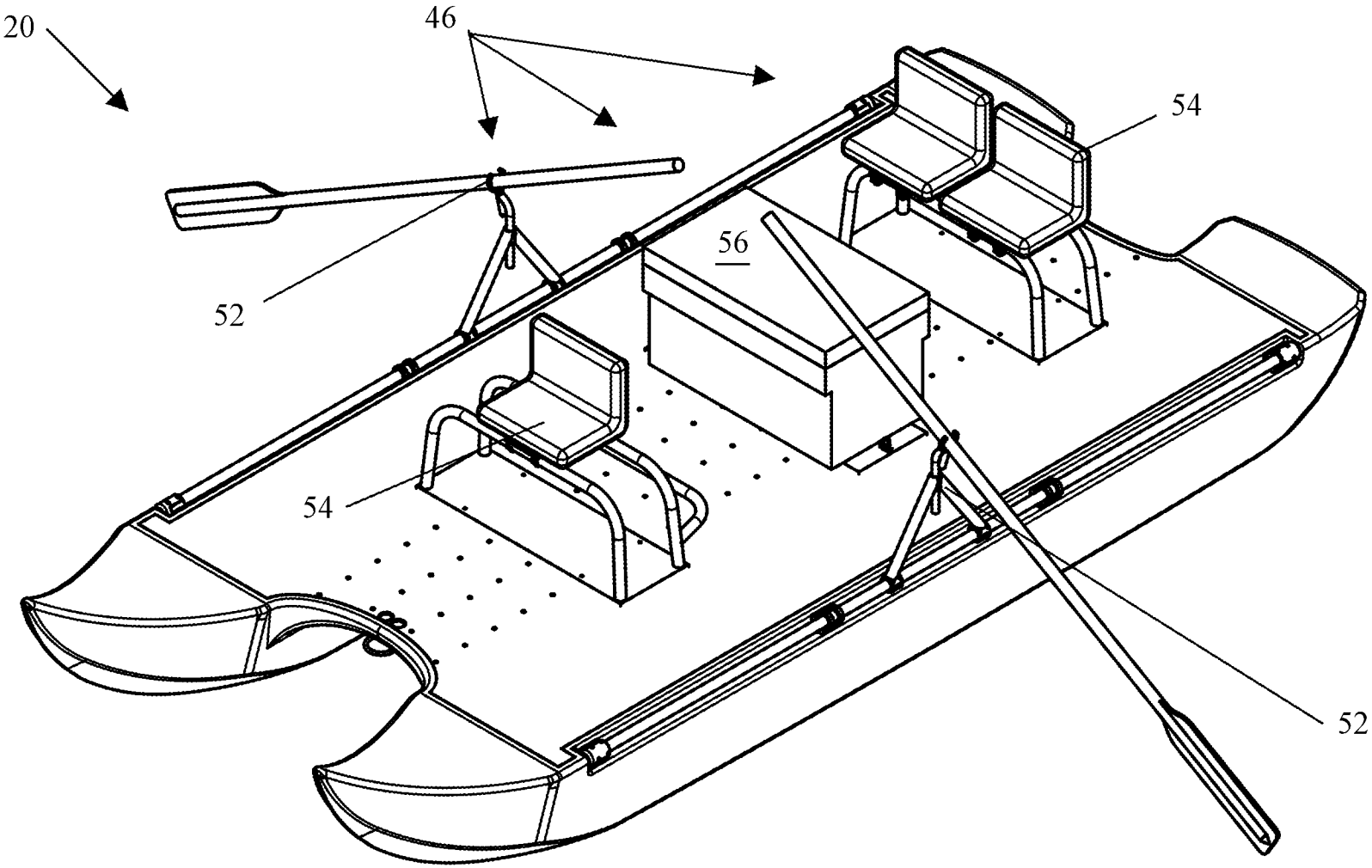

FIG. 6 illustrates a view of a rotomolded narrow beam catamaran with a seated oar driven configuration, in accordance with an embodiment of the present disclosure.

Figure 7:
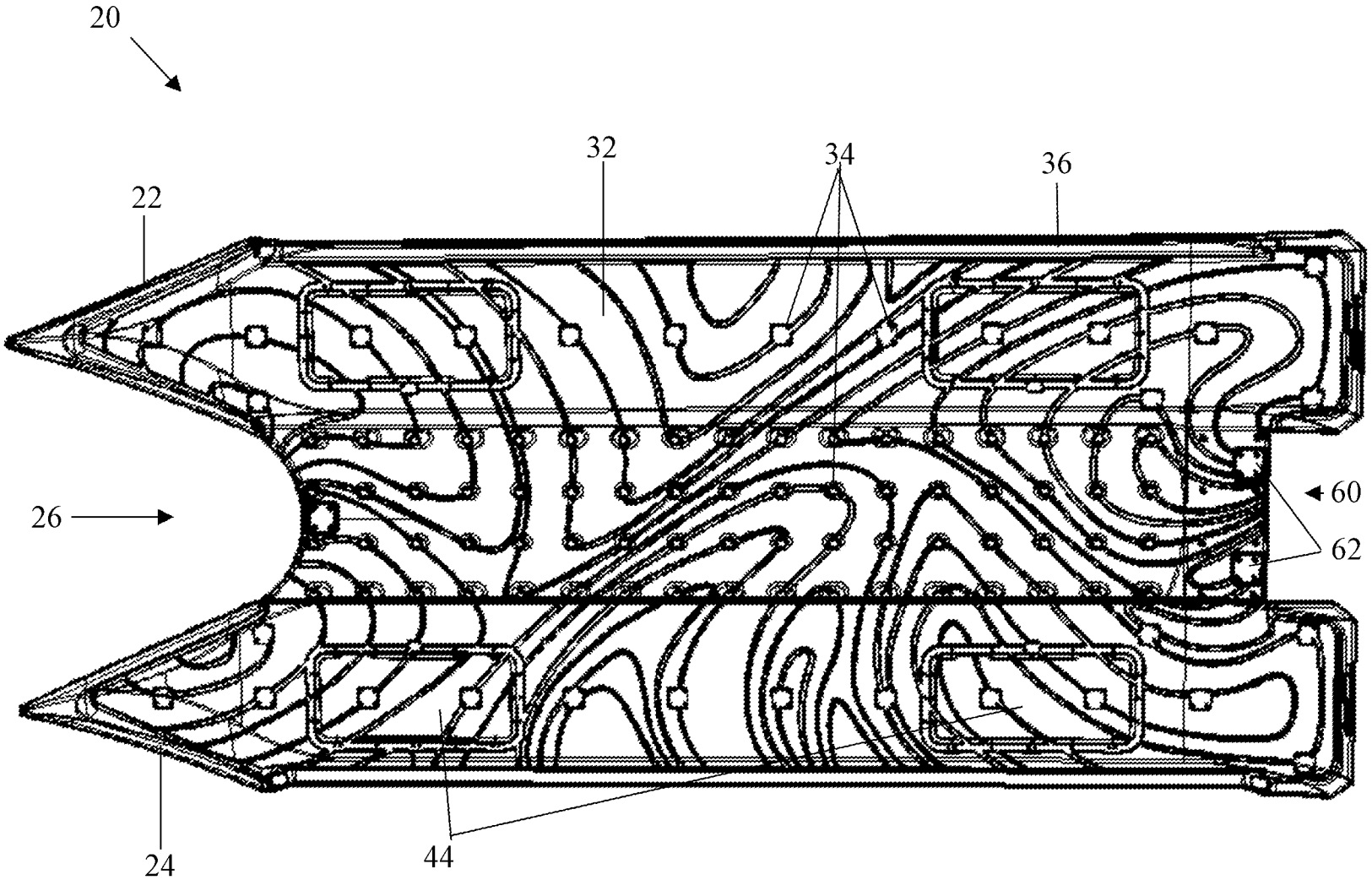

FIG. 7 illustrates a view of a rotomolded narrow beam catamaran with storage compartments and top platform Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure.

2. REFERENCES

20 Catamaran
22 Starboard Pontoon
24 Port Pontoon
26 Center Channel
28 Starboard Pontoon Bow Keel
30 Port Pontoon Bow Keel
32 Top Platform
34 Grid of Points of Attachment
36 Side Rail Tubular Frame
38 Starboard Pontoon Stern
40 Port Pontoon Stern
42 Point of Attachment for Towing
44 Storage Compartment
46 Modular Attachments
48 Motor
50 Center Console
52 Oars
54 Chairs
56 Cooler
58 Integrated Top Platform Surface Pattern
60 Transom
62 Backing plate that sandwiches the deck

DETAILED DESCRIPTION

The following description is not to be taken in a limiting sense but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure. Any alterations and further modifications in the illustrated devices, and such further application of the principles of the invention as illustrated herein are contemplated as would normally occur to one skilled in the art to which the invention relates.

Unless otherwise indicated, the drawings are intended to be read (e.g., arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightward", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the practice of the invention. At the very least, and not as an attempt to limit the application of the doctrine of equivalents to the scope of the claims; each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.3, or 5.5 to 10, or 2.7 to 6.1.

For the purposes of promoting an understanding of the principles of the present invention, reference will now be made to the embodiments illustrated in the drawings and specific language will be used to describe the same. The catamaran is designed to be a multi-use watercraft. Adaptable for use on rivers, bays, lakes, bayous, and oceans. The boat can be rigged out in many different ways so that it is customizable to the user. For example, a fly fisherman may have rod racks, cooler, swivel seats, leaning posts, and a casting platform; while someone who is interested in a multi-day expedition trip may choose to have cooler seats, dry boxes, and extra deck space designed in for gear storage.

The top of the boat is molded with many regularly arranged bosses and recesses that run along the tops of the catamaran to allow for base plates to be directly through-bolted to the top of the deck. Any variety of accessories can be welded to these base plates. Furthermore, the rails that run along the side of the boat, preferably along the gunwales, provide good mounting locations for oarlocks, folding access stairs, Bimini® tops, duck blinds, rod holders, lifting handles, and many more accessories. Taken together, these mounting locations allow the craft to be extremely adaptable to a multitude of different uses with readily available accessories.

Another innovation is the method of attaching the transom: the transom bolts through the deck to a backing plate, and effectively sandwiches the deck. The mounting bolts pass through molded-in bosses, and by using these bosses the hull is not penetrated in mounting the transom. This keeps the hull watertight and provides for a very strong mount.

FIGS. 1, 2, 3, and 4 illustrate a perspective view, a bottom view, a front view, and a rear view respectively of the same embodiment of a catamaran 20. As is typical for catamarans, the design features a dual hull design with starboard 22 and port 24 pontoons designed to be partially submerged underwater with a raised center channel 26 designed to ride above the waves thereby reducing drag while effectively providing a wider beam for improved stability and wave piercing ability compared to a standard keel. The aggressive entry of the catamaran's starboard pontoon bow keel 30 and port pontoon bow keels 32 allow it to handle large whitewater or waves with ease. The starboard pontoon stern 38 and port pontoon stern 40 have a flat abutment which is particularly convenient for mounting multiple types of motors 48. In addition to the two pontoons the catamaran 20 has top platform 32. At the bow of the boat there may be a point of attachment for towing or securing to a trailer 42 that may be a specialized plate with a ring. The hull of the catamaran 20 may also be fitted with one or more storage compartments 44.

The catamaran 20 may be designed to be manufactured using rotational molding technology. Any material suitable for rotational molding may be used; however, the ideal material would be a linear polyethylene, and as a result will be extremely durable. The catamaran may have integrated UV inhibitors to prevent exposure from the sun from breaking down the plastic. Additionally, the catamaran may contain inhibitors that protect the plastic from solvents, fuels, and oils. In other embodiments, the catamaran may be made of any material suitable to its purpose, such as wood, metal, plastics, polycarbonate, fiberglass, carbon fiber, or Kevlar. In one embodiment, the catamaran may be filled with an elastically deformable closed cell foam for buoyancy, such as expanded polyethylene (EPE), this will render the boats ultra-buoyant, making it extremely unlikely to be sunk.

The catamaran may range in sizes from 10 feet to 24 feet in length and no less than 4 feet wide and no more than 10 feet wide. In a preferred embodiment the catamaran is 13 feet long, has a beam of 6 feet 6 inches wide, has a draft rate of 1 inch per 100 lbs, is 2 feet 4 inches in height and has pontoon of a width of 2 feet and 4 inches. In another preferred embodiment the catamaran is 17 feet long, has a beam of 7 feet 6 inches wide, has a draft rate of 0.625 inches per 100 lbs, is 2 feet 5 inches in height and has pontoon of a width of 2 feet and six inches.

Along the top platform 32 (also called a deck) of the catamaran 20 there may be a grid of regularly spaced points of attachment 34 for the attachment of various modular attachments. The points of attachment may be holes through the top platform as shown, or it may be: threaded holes, bolts, nobs, toggles, snaps, clips, ropes, pegs, hooks, sockets, pressure fit sockets, clamps, hinges, levers, channels, slots, Velcro, tie on, magnetic, interface fits, buckles, screws, buttons, slides, elastic bands, or any other method for securely coupling two items known in the art. The points of attachment 34 may be arranged in an evenly spaced grid lengthwise along the top platform 32 of the catamaran ideally situated above the center channel 26 of the catamaran 20 when such points of attachment go all the way through the top platform as illustrated in the drawings. Ideally the grid of regularly spaced points of attachment would be at least two rows wide and have at least eight points of attachment. In an ideal embodiment the rows would be four or more rows wide and have at least thirty-two points of attachment evenly spaced from bow to stern along the top platform 32 above the center channel 26. These attachment points may be located in areas of the deck where the mold walls come close enough together to create a solid plastic mounting point with no foam in-between for greater stability. These attachment points allow an assortment of modular attachment to be easily used or removed.

As shown in FIG. 5 the catamaran may also have a side rail tubular frame 36 that may work as a handle and as a side rail mounting system that allows for the attachment of oars and other modular attachments 46. The tubular frame 36 may comprise aluminum tubing, possibly of a standard 1.5-inch aluminum pipe which may be tied together by 1 inch by 2-inch square aluminum tubing, giving the frame additional strength and rigidity. As seen in FIG. 6, oars 52 may be mounted to these tubes and may be movable. The siderails 36 may be tied together through the hull; giving them strength above and beyond what they would have if they were just bolted to embeds on the hull.

One of the best features of the catamaran is its versatility. The many points of attachment 34 and the side rail mounting system 36 both allow for quick and easy attachment oval of modular attachments 46. As seen in FIG. 5, such modular attachments may include one or more motors 48 and a Center Console 50 with steering mechanisms.

FIG. 6 illustrates another embodiment where a catamaran is outfitted with Oars 52, chairs 54 and a cooler 56 modular attachments. Additionally, any number of other modular attachments can be used, such as: additional outboard motors, trolling motors, electric; motors, paddles, additional coolers, fishing rod mounts, dry storage compartments, batteries, lights, drink holders, various configurations of rain/sun coverage, full tent enclosure, stereos, gun racks, waterfowl hunting blind packages. GPS or navigation packages, fish finder, anchor systems, ie down cleats, flip-up/folding entry or exit ladders, casting decks, poling platforms, fans, batteries, lights, drink holders, net holders, rain covers (roof)s, stereo systems, rod racks, swivel seats, or leaning posts.

FIG. 7 illustrates an embodiment of a catamaran with an integrated top platform surface pattern 58 that is molded into the top of the boat, assisting water run-off and foot traction on the top surface of the boat. FIG. 7 also illustrates a transom 60 that comprises a backing plate 62 that sandwiches the deck and is mounted through the deck using points of attachment that go through the deck.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. A rotomolded catamaran, comprising:
a starboard and a port pontoon;
a central channel between said pontoons;
a top platform;
a side rail tubular frame; and
wherein said side rail tubular frame is tied together through said top platform.

2. The rotomolded catamaran of claim 1, wherein said catamaran further comprises a grid of regularly spaced points of attachment on said top platform.

3. The rotomolded catamaran of claim 2, wherein said points of attachment are located along said central channel between said pontoons.

4. The rotomolded catamaran of claim 2, further comprising modular attachments that attach to said grid of regularly spaced points of attachment on said top platform.

5. The rotomolded catamaran of claim 1, wherein said side rail tubular frame is made of 1.5-inch aluminum pipe.

6. The rotomolded catamaran of claim 1, wherein said side rail tubular frame is tied together through said top platform with 1 inch by 2-inch square aluminum tubing.

7. A rotomolded catamaran, comprising:

a starboard and a port pontoon;

a central channel between said pontoons;

a top platform; and a transom made from a backing plate that sandwiches said top platform and is attached through a hole through said top platform.

8. The rotomolded catamaran of claim 7, wherein said catamaran further comprises a grid of regularly spaced points of attachment on said top platform.

9. The rotomolded catamaran of claim 8, wherein said points of attachment are located along said central channel between said pontoons.

10. The rotomolded catamaran of claim 8, further comprising modular attachments that attach to said grid of regularly spaced points of attachment on said top platform.

11. The rotomolded catamaran of claim 7, further comprising a motor attached to said transom;

a starboard and a port pontoon;

a central channel between said pontoons;

a top platform; and flat abutments on the rear of said pontoons for the attachment of motors.

12. The rotomolded catamaran of claim 11, wherein said catamaran further comprises a grid of regularly spaced points of attachment on said top platform.

13. The rotomolded catamaran of claim 12, wherein said points of attachment are located along said central channel between said pontoons.

14. The rotomolded catamaran of claim 12, further comprising modular attachments that attach to said grid of regularly spaced points of attachment on said top platform.

15. The rotomolded catamaran of claim 11, further comprising a motor attached to said flat abutments.

* * * * *